US005497746A

United States Patent [19]

Semence et al.

[11] Patent Number: 5,497,746

[45] Date of Patent: Mar. 12, 1996

[54] TWO-STAGE VALVE FOR FEEDING AIR TO INJECTORS OF AN INTERNAL COMBUSTION ENGINE

[75] Inventors: Pierre Semence, Chatou; Jean-Pierre Joigneau, Maule, both of France

[73] Assignee: Magneti Marelli France, France

[21] Appl. No.: 416,980

[22] Filed: Apr. 5, 1995

[30] Foreign Application Priority Data

Apr. 6, 1994 [FR] France ..... 94 04018

[51] Int. Cl.[6] ..... F02M 3/00

[52] U.S. Cl. ..... 123/339.27; 123/585; 123/327

[58] Field of Search ..... 123/327, 339.23, 123/339.25, 339.26, 339.27, 585

[56] References Cited

U.S. PATENT DOCUMENTS 4,989,564 2/1991 Cook et al. ..... 123/339.27

5,018,495 5/1991 Dougherty ..... 123/339.26

5,307,774 5/1994 Hammer ..... 123/585

*Primary Examiner*—Noah P. Kamen

*Attorney, Agent, or Firm*—Larson and Taylor

[57] ABSTRACT

A piston within the body of the valve is connected to an actuator and is integral with stops. After a first stroke of the piston from its position against the first seat, the first stops entrain second stops integral with a second piston, to entrain this with the first piston over a second stroke, from the position of application of the second piston to its seat. This feeds air-assisted injectors through the outlet over the first stroke, and in addition, over the second stroke to admit air through the outlet bypassing a throttle valve. Control of a single actuator allows the airflow to be regulated through each of the two outlets in succession.

10 Claims, 1 Drawing Sheet

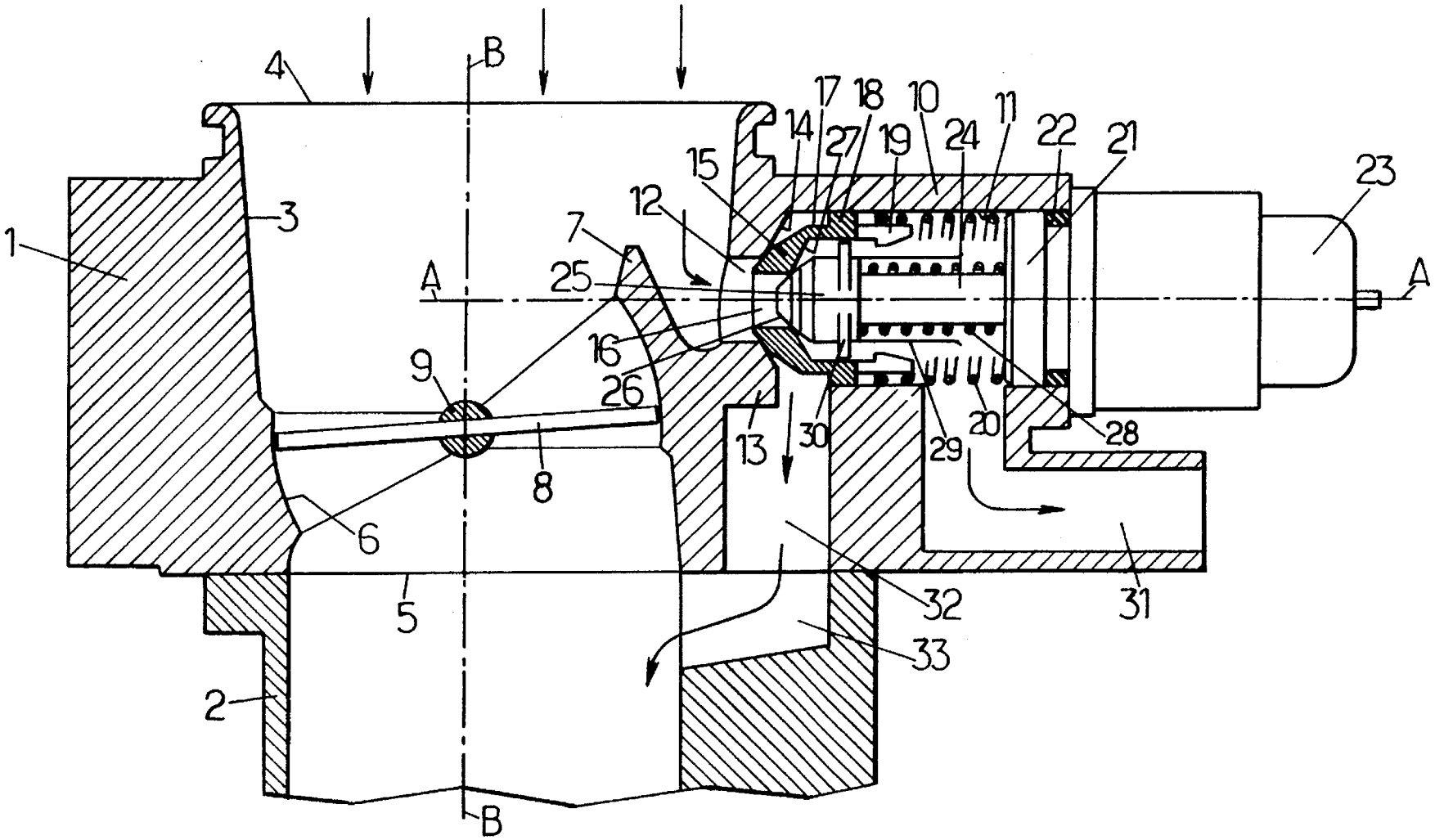
A
23
21
22
11
24
10
19
18
17
27
14
15
12
7
25
16
26
8
9
6
4
3
1
2
5
B
B
A
13
30
29
20
28
31
32
33

TWO-STAGE VALVE FOR FEEDING AIR TO INJECTORS OF AN INTERNAL COMBUSTION ENGINE

FIELD OF THE INVENTION

The invention concerns a two-stage valve firstly for feeding air to at least one air-assisted injector for injecting fuel into an inlet manifold of a fuel injection system of an internal combustion engine, and secondly, for bypassing a throttle device, such as a butterfly valve, which is movable in a duct, for regulating the air supply to the inlet manifold.

BACKGROUND OF THE INVENTION

In fuel injection systems for internal combustion engines, especially of the multipoint type, it is known that, for each cylinder of an engine, at least one injector delivers fuel to the corresponding branch of the inlet manifold. The inlet manifold being located directly upstream from the corresponding inlet valve(s), in the cylinder head of the engine. A butterfly valve body provides and regulates the air supply to the inlet manifold and, thus, to the engine located between the air filter and the inlet manifold, and having at least one duct therethrough. A throttle member in the form of a disk, called a butterfly valve, is mounted rotatably in the duct. The throttle member's position in the duct varies between a fully open position and a position in which the duct is more or less completely closed, depending on the position of the accelerator pedal and possibly on certain operating parameters of the engine.

The fuel atomization provided by the injectors may be improved by piercing the tip of an injector by at least one fuel outlet passage, defining a mixing chamber connected to an inlet for assisting air (U.S. Pat. No. 4,957,241). A three-port solenoid valve which regulates idling may also be used to draw off the flow of additional air supplied to each air-assisted injector (U.S. Pat. No. 5,048,496).

Fuel injection devices are also known in which the butterfly valve can close the inlet duct practically completely. The body of the butterfly valve includes an additional air duct whose inlet is located upstream from the butterfly valve and whose outlet is located downstream therefrom, and in which a solenoid valve controls the flow. Operating parameters of the engine control the solenoid valve. For example, the opening of the butterfly valve and speed of the engine regulate the idling speed and the water temperature and also the speed of the engine for cold starting. Reduction of pollution from exhaust gases during cold starting and when decelerating from high speeds as well as regulating of idling is thus possible.

French patent application FR 2 698 128 proposed an additional air duct, whose inlet is located upstream from the butterfly valve and whose flow can be controlled by a solenoid valve. This additional air duct ensures better fuel atomization when the engine operates in modes other than full load, especially when starting at a very low temperature (cold running), when decelerating from high speed and when running with a reduced load. The additional air duct feeds the air that has passed through the additional air solenoid valve to the mixing chamber of each of the air-assisted injectors and to a supplementary solenoid valve opening downstream from the butterfly valve.

In order to avoid the need to control two solenoid valves, which requires two actuators and complicates implementation of the control circuit, a two-stage valve has been proposed. The two-stage valve comprises a body having a moving assembly comprising first and second pistons, returned by resilient means to a position of sealed contact or of contact with minimum leakage against first and second seats respectively. This minimizes communication between at least one inlet in the body, fed with air from upstream of the throttle member, and respective ones of two outlets of the body, a first feeding the air-assisted injector(s), and the second feeding the manifold downstream from the throttle member. In order to place each outlet progressively in communication with the corresponding inlet, an actuator moves the moving assembly against the return of resilient return means by spacing the corresponding piston from its corresponding seat.

However, that implementation suffers from the problem that the two pistons are integral with a member controlled by an actuator, so that they are moved simultaneously relative to their respective seats. This precludes control and regulation of the airflow through one of the two outlets of the valve unless the airflow through the other is controlled and regulated.

However, the requirements for a regulated supply of additional air firstly to the air-assisted injectors and secondly to the inlet manifold, bypassing the butterfly valve, are not simultaneous.

SUMMARY OF THE INVENTION

The object of the invention is to overcome this problem and to provide a two-stage valve of the type referred to, which meets practical requirements better than the known valves of this type.

To this end the invention provides a two-stage valve wherein only the first piston is connected to the actuator and moves integrally with first stop means. After a first stroke of the first piston from its position of application to the first seat, the first stop means cooperates with second stop means, which moves integrally with the second piston, to entrain this with the first piston over a second stroke, from the position of application of the second piston to the second seat.

Thus, additional air can be sent to the air-assisted injectors through the first outlet, without additional air being admitted to the inlet manifold, bypassing the butterfly valve, when the operating conditions of the engine make this bypass supply of no use.

On the contrary, in the case of starting the engine from cold or when decelerating from high speed, when the butterfly valve is closed even though a relatively large airflow needs to be admitted to the engine, the entrainment of the second piston by the first, over the second stroke controlled by the actuator, provides the required airflow.

The actuator advantageously regulates the airflow through the first outlet to the air-assisted injector(s) by regulating the position of the first piston over the first stroke. The airflow through the second outlet is kept small or zero. This allows the motor to regulate while idling, because of the airflow passing through the air-assistance circuit for the injectors under normal idling conditions.

The actuator also advantageously regulates the airflow through the second outlet to downstream from the throttle member or butterfly valve by regulating the position of the second piston over the second stroke, in order for example to match the flow of air bypassing the butterfly valve to a deceleration maneuver from high speed, or to regulate the flow of additional air in dependence on the engine temperature when cold starting.

The inlet sections of the two circuits are dimensioned to ensure that the airflow through the first outlet remains at its maximum when the pistons are displaced over the second stroke.

In an advantageous embodiment of structure that is simple and reliable, the actuator acts linearly and axially displaces a rod integral with the first piston. The second piston is annular and mounted to slide axially in the body and disposed substantially around the assembly formed by the rod and the first piston. The assembly carries the first stop means which cooperate with the second stop means integral with the second piston.

Each piston can move in a respective one of two axial chambers in the body. The corresponding outlet opens radially into each chamber. The respective, annular and axial seat is formed in each chamber. The rod passes through a partition separating the two chambers which are in line with each other, and carries the stop means entraining the second piston.

However, this design suffers from the problem of being bulky, especially axially, and being demanding in respect of seals.

SUMMARY OF THE INVENTION

For these reasons, in the preferred embodiment of the invention, the first seat is defined around the central passage of the (annular) second piston, opposite its face. The face of the second piston comes into contact with the second seat, which surrounds a single air inlet in the body.

The second piston can have a tubular skirt guided axially in a single axial chamber of the body and in which the first piston moves axially over at least part of its first stroke. The second stop means comprises at least one hook carried by the skirt and projecting therein. The first stop means comprises at least one lug projecting laterally from the first piston and cooperating with the hook(s) of the skirt, in order to entrain the second piston over the second stroke.

This implementation of the two-stage valve with a single axial chamber in which the two pistons are fitted, one being annular, facilitates implementation of the body of the valve. The body of the valve can be at least partially, and preferably completely, integral with the body forming the duct which houses the movable throttle member, while the single air inlet of the valve body can open directly into the duct upstream from this throttle member.

In a simple and reliable manner, a wall can close the body of the valve on the side opposite its single air inlet the rod passes through this wall, which supports the actuator and against which the resilient return means comprising two helical springs abuts. The first spring surrounds the rod and biases the first piston. The second spring surrounds the first spring and biases the second piston.

In order to regulate accurately the axial position of the first piston over the first stroke and the axial position of both pistons over the second stroke, and thus to regulate accurately the airflows through both outlets, the linear actuator is advantageously an electric stepper motor.

BRIEF DESCRIPTION OF THE DRAWING

Other features and advantages of the invention will appear from the description given below, by way of non-limiting example, of an embodiment described with reference to the sole FIGURE, which shows an integrated butterfly valve and two-stage valve body, partly in axial section and partly in side elevation.

DETAILED DESCRIPTION OF THE PREFERRED EMBODIMENTS

In the sole FIGURE, a butterfly valve body is attached to an inlet manifold 2 and traversed by a duct 3. The duct inlet 4 is connected by means not shown to the outlet of an air filter and the duct outlet 5 opens into the manifold 2. The duct 3 has a region 6 of varying section in the form of a zone of a sphere. A lip 7 projecting from the central part of the body 1 towards the interior of the conduit 3 and towards the inlet 4 delimits the sphere on one side, i.e. facing upstream. A butterfly valve 8, forming the throttle member of the duct 3 relative to the manifold 2 and having the shape of a circular disk, is mounted on a diametrical spindle 9. Conventional means rotate the spindle 9 in the region 6 having the shape of a surface of revolution inside the duct 3.

On one of its sides, the body 1 has an appendage 10 forming a valve body. A cylindrical chamber 11, whose axis A-A is radial relative to the axis B-B of the duct 3 is formed in the appendage 10. The chamber 11 communicates with the duct 3 through a single axial inlet 12 (relative to A-A) opening upstream from the base of the lip 7 and thus upstream from the butterfly valve 8. The circular cross-section of the inlet 12 is less than the cross-section of the chamber 11. The inlet 12 is thus formed in a wall 13 separating the duct 3 from the chamber 11. The side of the wall 13 facing the inside of the chamber 11 forms an annular, frusto-conical seat 14 for an annular piston 15 having a substantially frusto-conical face for application against the seat 14. This piston 15 has a central passage 16 facing the inlet 12. The piston 15 is continued on the side opposite the inlet 12 in a cylindrical skirt 17 with a bearing rim 18. The piston 15 is mounted slidably along the axis A-A and guided axially in the chamber 11 by the bearing rim 18. On the side opposite the frusto-conical head of the piston 15, at least one pair of diametrically opposite hooks 19 axially continue the skirt. Each hook has a tooth projecting radially relative to the axis A-A towards the inside of the skirt 17. A helical spring 20 resiliently and axially biases (relative to A-A) the piston's external frusto-conical face against the frusto-conical seat 14. The spring 20 bears at one end against the bearing rim 18, between the hooks 19 and wall of the chamber 11, and, at the other end, against a partition wall 21. The partition wall 21 closes the chamber 11 at its end opposite from the inlet 12. The seal 22 minimizes leakage. The bottom supports a linear actuator 23 formed by an electric stepper motor which moves a rod 24 axially. The rod passes through the wall 21 and carries another piston 25 on its end inside the chamber 11. The piston 25 is not annular but also has a head 26 with a substantially frusto-conical external face, the resilient return bias of another helical compression spring 28 applies the piston head 26 against another annular, frusto-conical seat 27. Seat 27 is formed on the internal face of the piston 15 around its central passage 16. The helical compression spring 28 also bears at one end on the bottom 21 and at the other end against the piston 25. The spring 28 surrounds the rod 25 and lies between the rod 24 and a tubular, axial skirt 29 carried by the piston 25. The rod 24 and skirt 29 guide the spring 28 and prevent any interference between its turns and the hooks 19 of the piston 15. The piston 25 also has lugs 30 projecting radially outward and forming mechanical stops adapted to cooperate with the hooks 19. The lugs 30 also form entraining mechanical stops, in a manner described below.

Finally, two air outlet channels 31 and 32 are formed in the appendage 10 and open radially (relative to the axis A-A) into the chamber 11 the first outlet channel 31, opens between the bottom 21 and the pistons 15, 25 and the second outlet channel 32 opens facing the skirt 17 of the piston 15, between the bearing rim 18 and the seat 14 of the chamber 11. This second outlet channel 32 continues as a channel 33 formed in the manifold 2 and opening into the continuation of the inlet duct 3, downstream from the butterfly valve 8.

The two-stage valve thus formed is compact and of balanced structure: it comprises a single chamber 11 with a single inlet 12, two pistons 15 and 25. The piston 15 slides axially in the chamber 11 and the rod 24 axially moves the tubular structure piston 15. The actuator 23 operates the rod 24. The return springs 20 and 28 are coaxial and return the pistons 15 and 25 into their initial positions, as shown in the sole FIGURE. In this initial position, the internal piston 25 closes the central passage 16 under the bias of the spring 28, through its application to the seat 27 in the piston 15. The spring 20 biases the piston 15 to close the inlet 12.

The airflow through the outlet channels 31 and 32 is thus very small or zero.

In operation, the stepper motor 23 regulates the axial position of the piston 25 the motor 23 spaces the head 26 from the internal seat 27 in the other piston 15, over a first axial stroke defined by the axial distance between the lugs 30 of the piston 25 and the projecting teeth of the hooks 19 of the piston 15. By regulating the displacement of the piston 25 over this first axial stroke, the motor 23 regulates the airflow passing through the inlet 12 and the passage 16, then between the seat 27 and the piston 25, and through the first outlet channel 31 connected to the air-assisted injectors. The motor 23 thus regulates the flow of assisting air for the injectors, allowing regulation of idling mode under normal engine temperature conditions, up to a flow of about 20 kg/h when the piston 25 has executed the whole first axial stroke. This first stroke can be 2 mm for example and can be obtained with 50 rotary steps of the stepper motor 23.

If the injectors demand additional air, especially when starting the engine from cold or during deceleration from high speed, the stepper motor 23 moves the piston 25 by the rod 24 over a second axial stroke. In the second axial stroke, the lugs 30 of the piston 25 are in mechanical abutment with the hooks 19 of the skirt 17. The lugs 30 entrain the piston 15, spaced from the seat 14, so that the air passes through the opening 12, then between the seat 14 and the piston 15, through the outlet channel 32, and flows into the channel 33 and the manifold 2, bypassing the butterfly valve 8, which is closed during such operating conditions. An additional airflow can thus be admitted. This airflow can reach about 60 kg/h, when the pistons 25 and 15 have been shifted over a second axial stroke of about 6 mm, through additional displacement of 150 steps of the stepper motor 23.

The two-stage valve thus integrated with the body 1 of the butterfly valve allows the motor 23 to regulate the flow passing through the outlet 31 to the air-assisted injectors over the first to the fiftieth steps of the motor 23. The two-stage valve also allows the motor 23 to regulate the flow of air through the outlet 32, bypassing the butterfly valve 8, between the fifty-first and the two-hundredth steps, while the airflow through the outlet 31 to the air-assisted injectors is kept at its maximum.

When the electric stepper motor 23 is not energized, the return springs 20 and 28 push the pistons 15 and 25 back against the seats 14 and 27 in a position blocking the inlet 12 and the central passage 16, cutting off communication between the inlet 12 and the outlets 32 and 31.

The two-stage valve is simple and reliable and suffers from little or no friction, with small risk of the air passages clogging. It is also very easy to control.

We claim:

1. A two-stage valve for feeding air to at least one air-assisted injector for injecting fuel into an inlet manifold of a fuel injection system for an internal combustion engine, and for bypassing a throttle device which is movable in a duct, for regulating air supply to the inlet manifold, the valve comprising a body including a movable assembly comprising first and second pistons, each of said pistons being returned by resilient means towards a position of application, with minimal leakage, against first and second seats respectively, in order to reduce to a minimum communication between at least one air inlet in the body which is fed with air from upstream from the throttle device, and respective outlets from the body, the movable assembly being movable by an actuator against action of the resilient return means for placing each outlet in communication with the air inlet by spacing the corresponding piston from its corresponding seat, only a first of said pistons being connected to the actuator and moving integrally with first stop means which, after a first stroke of the first piston from a position of application to the first seat, cooperates with second stop means which move integrally with the second piston to entrain the second piston with the first piston over a second stroke, from the position of application of the second piston to the second seat.

2. The valve according to claim 1, wherein the actuator regulates airflow through the first outlet by regulating position of the first piston over the first stroke.

3. The valve according to claim 1, wherein the actuator regulates airflow through the second outlet by regulating position of the second piston over the second stroke.

4. The valve according to claim 1, wherein airflow through the first outlet remains at a maximum while the pistons are displaced over the second stroke.

5. The valve according to claim 1, wherein the actuator acts linearly and axially displaces a rod integral with the first piston, the second piston being annular and mounted to slide axially in the body and being disposed substantially around an assembly formed by the rod and the first piston, said assembly carrying the first stop means which cooperates with the second stop means integral with the second piston.

6. The valve according to claim 5, wherein the first seat is defined around central passage of the second piston, opposite face of the second piston which comes into contact with the second seat surrounding air inlet in the body.

7. The valve according to claim 6, wherein the second piston includes a tubular skirt guided axially in a single axial chamber of the body, and in which the first piston is moved axially over at least part of the first stroke, the second stop means comprising at least one hook carried by the skirt and projecting therein, the first stop means comprising at least one lug projecting laterally from the first piston and cooperating with the hook of the skirt.

8. The valve according to claim 6, wherein the body is at least partially in one piece with a second body in which the duct which houses the movable throttle member is formed, the single air inlet of the valve body opening directly into the duct upstream from said throttle member.

9. The valve according to claim 8, wherein the body of the valve is closed on a side opposite the single air inlet by a partition wall through which the rod passes and which supports the actuator and against which abuts the resilient return means comprising two helical springs, a first of said helical spring surrounding the rod and biasing the first piston and a second of said helical springs surrounding the first helical spring and biasing the second piston.

10. The valve according to claim 1, wherein the actuator comprises an electric stepper motor.

* * * * *